US005988094A

United States Patent [19]

Obrinski

[11] Patent Number: 5,988,094

[45] **Date of Patent: *Nov. 23, 1999**

[54] MOORING LINE RECEPTACLE APPARATUS

[76] Inventor: Brad Alan Obrinski, 38716 Golfview, Clinton Twp., Mich. 48038

[ * ] Notice: This patent is subject to a terminal disclaimer.

[21] Appl. No.: 08/791,973

[22] Filed: Jan. 31, 1997

Related U.S. Application Data

[63] Continuation-in-part of application No. 08/540,081, Oct. 6, 1995, Pat. No. 5,598,805.

[51] Int. Cl.[6] ..... B63B 17/00

[52] U.S. Cl. ..... 114/230; 114/218; 114/221 R

[58] Field of Search ..... 114/218, 230, 114/221 R; 24/115 A, 129 R, 129 D

[56] References Cited

U.S. PATENT DOCUMENTS

| | | | |
|---|---|---|---|
| 2,832,116 | 4/1958 | Clevett, Jr. et al. | 24/129 D |
| 3,012,736 | 12/1961 | Burst | 114/230 |
| 3,464,113 | 9/1969 | Silverman et al. . | |
| 3,841,685 | 10/1974 | Kolodziej | 114/230 |
| 3,897,745 | 8/1975 | Hutchings | 114/218 |
| 4,109,603 | 8/1978 | Guthmann | 114/230 |
| 4,114,553 | 9/1978 | Zikek | 114/230 |
| 4,519,643 | 5/1985 | Harris | 114/221 R |
| 4,648,159 | 3/1987 | Dougherty | 24/129 R |
| 4,912,816 | 4/1990 | Brandt | 114/230 |
| 5,050,813 | 9/1991 | Ishikawa et al. | 24/129 R |
| 5,116,260 | 5/1992 | Upchurch | 114/221 R |
| 5,598,805 | 2/1997 | Obrinski | 114/230 |

*Primary Examiner*—Sherman Basinger
*Attorney, Agent, or Firm*—Peter D. Keepe

[57] ABSTRACT

A mooring line receptacle apparatus for a watercraft includes an elongated mooring line receptacle for each mooring line, wherein each mooring line receptacle is connected with the hull of the watercraft preferably at the gunwale thereof; and further includes an abutment member connected with each mooring line at a distal end thereof. The mooring line receptacle has an interior hollow defined by a sidewall composed of a durable material having a slot therein along its entire length. The sidewall opposite the slot is attached to the hull of a selected watercraft via threaded fasteners. One mooring line receptacle is located at the port bow, another at the starboard bow, another at the port stern and another at the starboard stern. Preferably, each of the sets of port and starboard mooring line receptacles end near each other at a generally amidship location on the gunwale where the skipper and crew/passengers enter and leave the watercraft. The mooring line is composed of conventional material used for nautical moorage, and has an abutment member at its distal end. The slot has a width either smaller than the cross-section of the mooring line such that the mooring line is forced through the slot into the interior hollow of the mooring line receptacle or is larger than the cross-section of the mooring line such that the mooring line easily passes through the slot. Thereupon, the mooring line rests storingly in the interior hollow for storing the mooring line when not in use.

17 Claims, 5 Drawing Sheets

MOORING LINE RECEPTACLE APPARATUS

CROSS REFERENCE TO RELATED APPLICATIONS

The present patent application is a continuation-in-part application of Ser. No. 08/540,081, filed on Oct. 6, 1995, now U.S. Pat. No. 5,598,805.

BACKGROUND OF THE INVENTION

1. Field of the Invention

The present invention relates to mooring lines used for mooring watercraft to dock facilities, and more particularly to a receptacle located on the watercraft for storing the mooring line in a ready to use outstretched configuration when the mooring line is not in use.

2. Description of the Prior Art

Watercraft, such as motor and sail boats, utilize fore and aft mooring lines at each of the port and starboard sides thereof to secure the watercraft to a dock facility. In this regard, the dock facility generally has a number of cleats or other structures, such as pilings, to which mooring lines of the watercraft may be connected.

Typically, a watercraft will have a mooring line for being connected with cleats on the watercraft in anticipation of future and present docking needs. Cleats are usually provided fore and aft at each of the starboard and port sides of the watercraft, whereupon four mooring lines would be needed to be connected to these four cleats.

Problematically, when a skipper leaves dock, the mooring lines may be loosely placed on the boat deck, whereafter they may slide off and then dangle into the water. Dangling mooring lines are, of course, unsightly and they can add drag and pose other problems to operation of the watercraft. On the other hand, if the mooring lines are secured to some component of the boat deck to prevent potential dangling, then when the mooring lines need to be made ready for docking considerable time and effort must be expended to free the lines. This lost time could be critical if a skipper is in need of a fast securement to the dock in the event of an untoward docking situation, such as when other boats may limit free navigation or high seas or winds make docking particularly tricky.

Accordingly, what is needed in the art is some effective, simple and easy to use way to hold mooring lines in a stored state, yet be instantly available when docking is imminent.

SUMMARY OF THE INVENTION

The present invention provides and effective, simple and easy to use way to hold mooring lines in a stored state with respect to the watercraft, yet the mooring lines are instantly available when docking is imminent.

A first mooring line receptacle apparatus according to the present invention includes an elongated mooring line receptacle for each mooring line, wherein each mooring line receptacle is connected with the hull of the watercraft at the gunwale thereof; and further includes a mooring line having an abutment member connected to the distal end thereof. The mooring line receptacle has an interior hollow formed by a sidewall composed of a durable, resilient material having a longitudinal slot therein. The sidewall opposite the slot is attached to the hull of a selected watercraft via threaded fasteners. One mooring line receptacle is located at the port bow, another at the starboard bow, another at the port stern and another at the starboard stern. Preferably, each of the sets of port and starboard mooring line receptacles end near each other at a location on the gunwale where the skiper and crew/passengers enter and leave the watercraft, generally aship of the watercraft. The mooring line is conventional nylon or other rope material used for nautical moorage. The slot has a width smaller than the cross-section of the mooring line, such that the mooring line can be forced progressively through the slot into the interior hollow of the mooring line receptacle, and thereupon be trapped therein such that the mooring line cannot fall out of the hollow through the slot. The abutment member then abuts the end of the mooring line receptacle to thereby prevent the distal end of the mooring line from sliding into the interior hollow.

In operation, each of the port bow port stern, starboard bow and starboard stern mooring lines have the proximate ends thereof looped over or otherwise connected with their respective cleat on the watercraft. Each mooring line is then respectively pressed into its mooring line receptacle progressively along the slot thereof. When docking, the skipper or a crew member grabs a mooring line, via the abutment member thereof, on the side of the watercraft facing a dock facility, and then pulls upon the mooring line to thereby free it from its mooring line receptacle via exiting progressively along the slot thereof. The person then secures that mooring line in a conventional way to the dock facility, such as for example at a dock cleat or dock piling. Other of the mooring lines are then grabbed at their respective abutment member, freed and tied as was done with the first mooring line. When it is time to shove-off, the mooring lines tied to the dock facility are released therefrom and then slipped progressively through the slot of their respective mooring line receptacles for later use when docking is to again take place.

A second mooring line receptacle apparatus according to the present invention is generally similar to the aforementioned first mooring line receptacle apparatus, where now the mooring line freely passes through the slot and is not forced therethrough. The mooring line simply lays in the interior hollow of the mooring line receptacle and is held substantially taught by an abutment member which is snappably engageable into the slot. Preferably, the abutment member is adjustably positionable on the mooring line to thereby be positioned to abut the far end of the mooring line receptacle when the mooring line is resident therein. A guide member at the near end of the mooring line receptacle aids to guide the mooring line into the slot when the mooring line is being stored thereinside.

Accordingly, it is an object of the present invention to provide a mooring line receptacle apparatus for a watercraft which provides for easy, simple, outstretched storage of mooring lines in readiness for use when docking the subject watercraft.

It is another object of the present invention to provide a mooring line receptacle apparatus which provides convenient grabbing of mooring lines for rapid deployment during dockage of the subject watercraft.

It is a further object of the present invention to provide attractive storage of mooring lines accompanied by quick ablity to access the mooring lines when needed.

It is an additional object of the present invention to provide simple and easy storage of mooring lines without any possibility for the mooring lines to become tangled.

These and additional objects, advantages, features and benefits of the present invention will become apparent from the following specification.

DETAILED DESCRIPTION OF TEE PREFERRED EMBODIMENT

Figure 1:
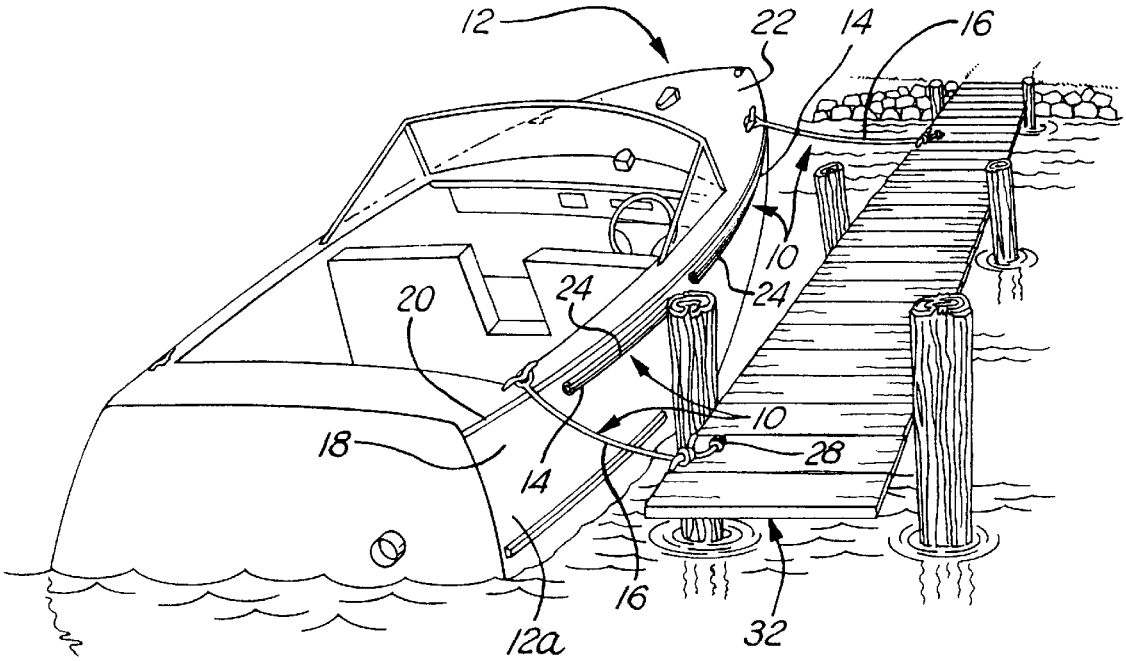
FIG. 1 is a perspective view of a watercraft equipped with a first mooring line receptacle apparatus according to the present invention.

Referring now to the Drawing, FIG. 1 generally depicts the mooring line receptacle apparatus according to the present invention in operation with respect to a watercraft 12 and a dock facility 32, wherein a first mooring line receptacle apparatus 10 is depicted by way of example. FIGS. 2 through 5 depict the first mooring line receptacle apparatus 10, while FIGS. 6 through 15B depict a second mooring line apparatus according to the present invention, wherein same overlap therebetween is present, as referenced hereinbelow.

As shown by FIGS. 3, 4 and 6 and 11, the first and second mooring line receptacle apparatus 10, 10' include an elongated mooring line receptacle 14, 14' for each mooring line 16, 16'. Each mooring line receptacle 14, 14' is secured to the hull 12*a*, 12*a'* of the watercraft 12, 12' at the gunwale 18, 18' thereof, preferably adjacent the bumper 20, 20' (if present) at a location with respect thereto which is further below the deck 22, 22', so that it is out of the way yet easily reached from the deck. Each mooring line receptacle 14, 14' has an interior hollow 30, 30' which communicates with a slot 24, 24' running the length thereof.

Figure 3:
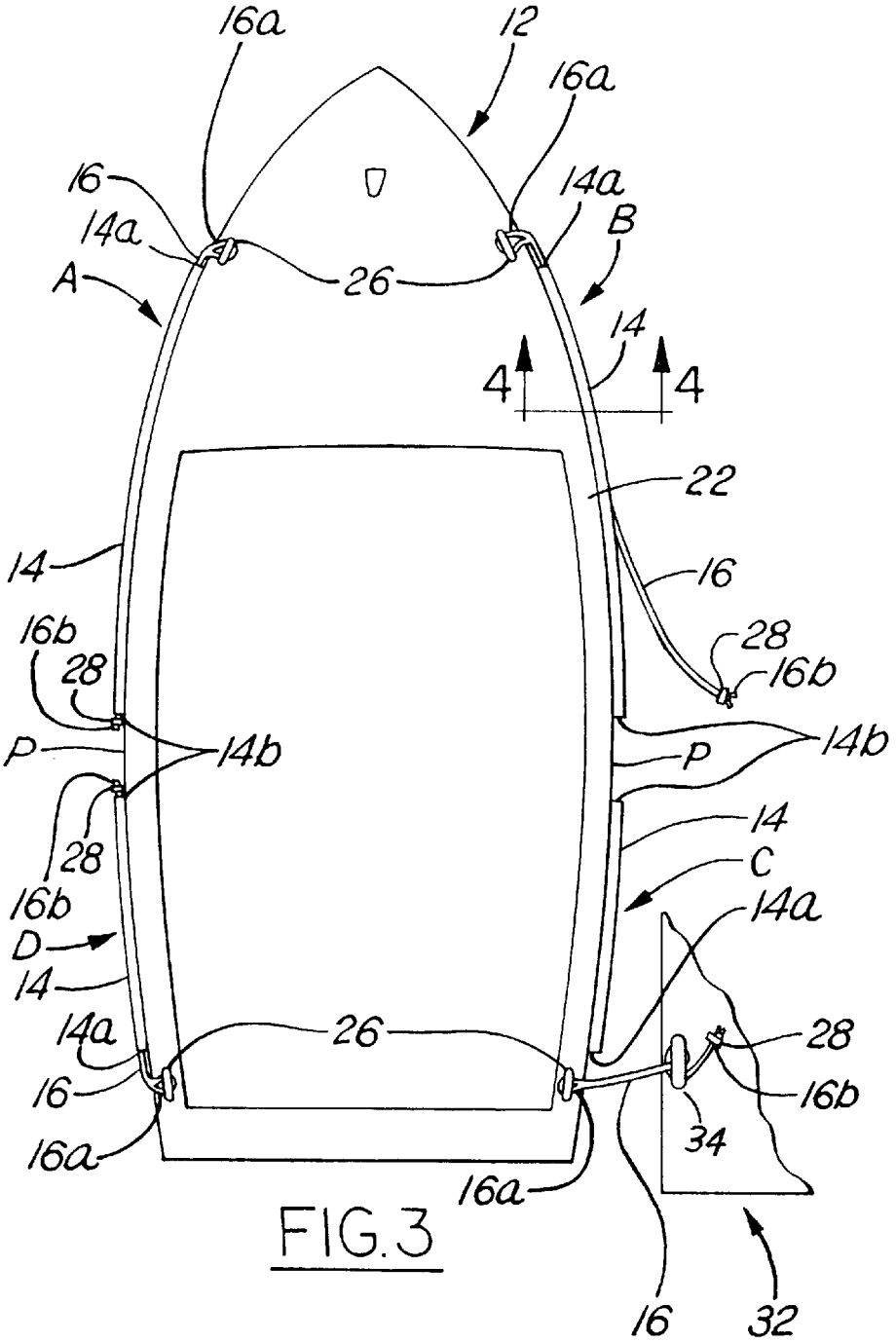
FIG. 3 is a plan view of a watercraft equipped with the mooring line receptacle apparatus of FIG. 1, the bumper of the watercraft being omitted for clarity.
Figure 6:
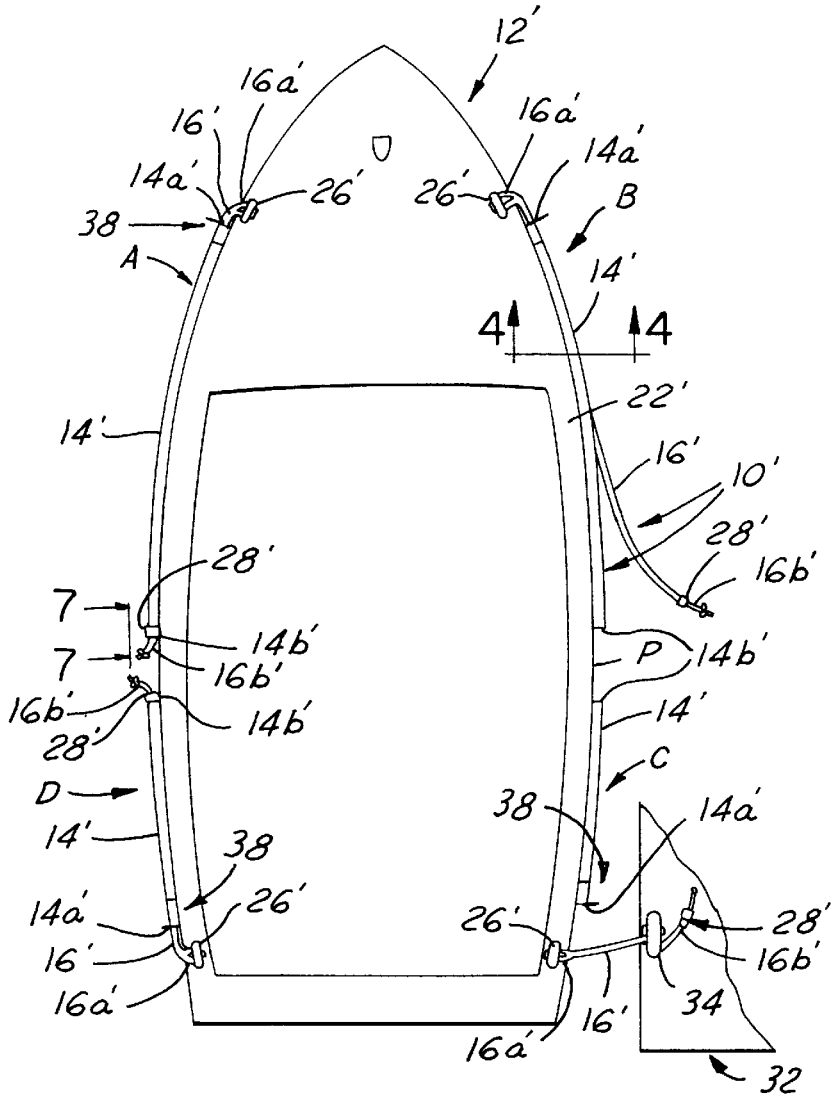
FIG. 6 is a plan view of a watercraft equipped with a second mooring line receptacle apparatus according to the present invention, the bumper of the watercraft being omitted for clarity.

As indicated by FIGS. 3 and 6, it is preferred to provide four mooring line receptacles 14, 14' at each of the port bow A, starboard bow B, starboard stern C, and port stern D. In this regard, there is one mooring line receptacle 14, 14' for each mooring line 16, 16' of the four locations (port bow A, starboard bow B, starboard stern C, and port stern D) of cleats 26, 26' of the watercraft 12, 12'. The proximate end 16*a*, 16*a'* of each mooring line is connected conventionally (by a loop or a knot) with a respective cleat 26, 26', as shown in FIGS. 3 and 6. The mooring line receptacles 14, 14' each have a near end 14*a*, 14*a'* and a far end 14*b*, 14*b'*, wherein the near end is located adjacent a respective cleat 26, 26'. The mooring line receptacles 14, 14' are elongated so that at each of the port side A, D and the starboard side B, C of the watercraft 12, 12', the far end 14*b*, 14*b'* of the mooring line receptacles are located more-or-less amidship. There is preferred to be a small separation between the far ends 14*b*, 14*b'* of the port A, D and starboard B, C mooring line receptacles 14. Further, as depicted in FIGS. 3 and 6, it is preferred for the port bow A and starboard bow B mooring line receptacles 14, 14' to be longer than the starboard stern C and port stern D mooring line receptacles so that the far end 14*b*, 14*b'* thereof is located amidship further toward the stern, preferably about two-thirds the length of the water craft as measured from the bow (indicated by point P in FIGS. 3 and 6) where the skipper and crew/passengers enter and leave the watercraft.

The mooring lines 16, 16' are composed of any nautically suitable mooring line material, such as three strand nylon. The mooring lines 16, 16' each have a proximate end 16*a*, 16*a'* which is connected to a respective cleat 26, 26' of the watercraft, as discussed hereinabove. The mooring lines 16, 16' each have an opposite distal end 16*b*, 16*b'* which includes an abutment member 28, 28'. The abutment member 28, 28' is structured to interface with the far end 14*b*, 14*b'* of a respective mooring line receptacle 14, 14', whereby the distal end 16*b*, 16*b'* of the mooring line is abuttingly prevented from sliding into the interior hollow 30, 30' and then becoming "lost" inside the mooring line receptacle. The abutment member 28, 28' further serves as a convenient handle for a person to grab hold of to pull upon the mooring line 16, 16' to thereby pullingly free it from storage within its mooring line receptacle.

Figure 2:
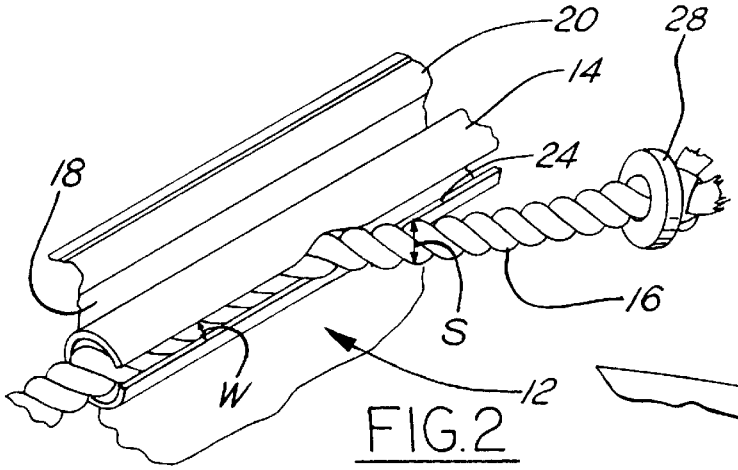
FIG. 2 is a detail perspective view showing the mooring line receptacle apparatus of FIG. 1 in operation.
Figure 5:
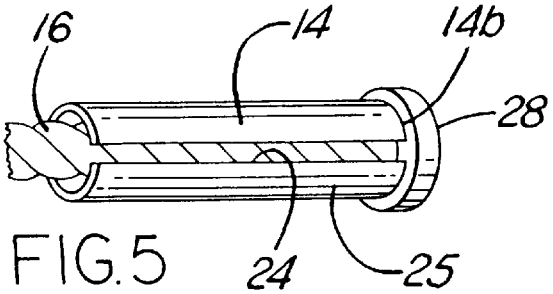
FIG. 5 is a partly sectional perspective view of the far end of a mooring line receptacle abutting the distal end of a mooring line in a manner according to the present invention.

As shown by FIGS. 2 and 5, a preferred form of abutment member 28 is a plastic disk having a central hole through which the mooring line 16 is passed and a retaining knot tied to prevent the distal end 16*b* from passing back therethrough. In its simplest form, the abutment member 28 could be an appropriately sized knot tied in the distal end of each of the mooring lines.

Figure 7:
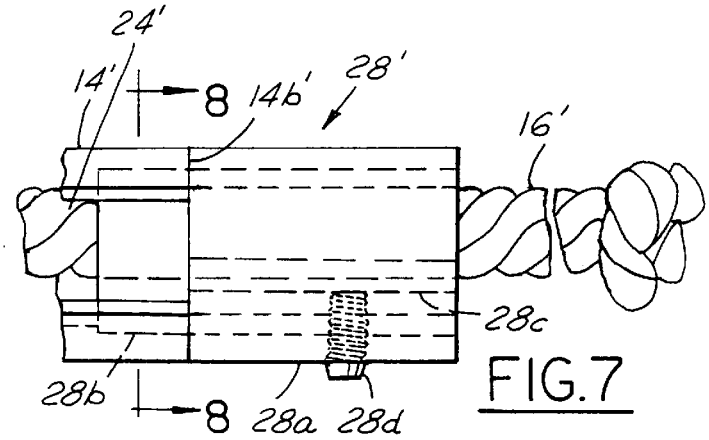
FIG. 7 is a partly sectional side view of an adjustable abutment member according to the present invention, shown in operation with a mooring line.
Figure 8:
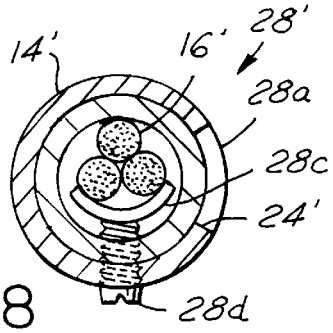
FIG. 8 is a partly sectional view of the adjustable abutment member and mooring line seen along line 8—8 in FIG. 7.
Figure 9:
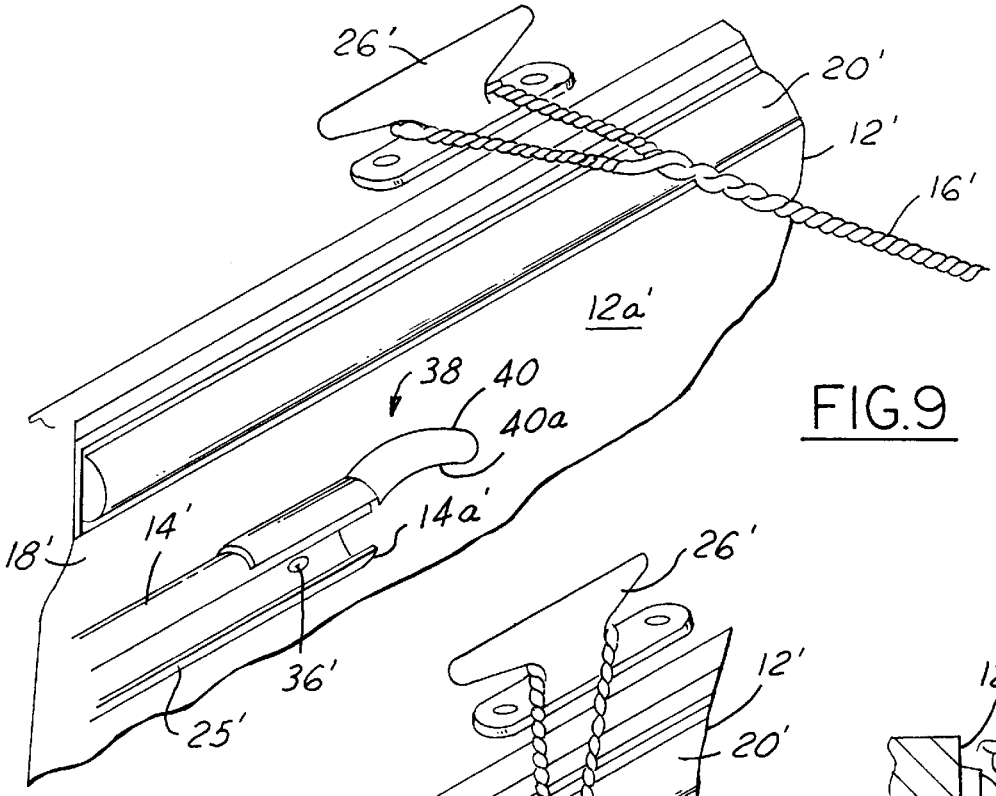
FIG. 9 is a broken-away perspective view of a vessel having the mooring line receptacle apparatus of FIG. 6, showing in particular a guide member thereof in the form of a guide arm member.

As shown by FIGS. 7 and 8, a preferred form of abutment member 28' is adjustably connected with the mooring line 16'. A plastic or metallic collar 28*a* has a sleeve 28*b* for snappingly interfacing with the slot 24'. The cross-section of the collar 28*a* is larger than that of the sleeve 28*b* so as to provide an abutment with the far end 14*b'* of the mooring line receptacle 14'. Internal to the collar 28*a* is a compression fitting 28*c* which is forced against the mooring line 16' by an adjustment screw 28*d*. Adjustability of position of the abutment member 28' allows for easy and simple accommodation of a new mooring line installation and possible changes in mooring line length occasioned by weather or dock conditions. It will be noted that the abutment member 28' can be used with both the first and second mooring line receptacle apparatus 10, 10'.

Alternatvely, a portion of the mooring line receptacle 14' at its far end 14*b*' can have a reduced slot width (less than W' shown in FIG. 11) so as to be less than the diameter of the mooring line 16' and operate with an abutment member in the manner shown in FIG. 2.

Each mooring line 16, 16' and its respective mooring line receptacle 14, 14' are dimensionally paired such that the distal end 16*d*, 16*d*' of the mooring line has only a relatively small overlap beyond the far end of its respective mooring line receptacle when each mooring line is connected with its respective cleat 26, 26', as generally indicated by FIGS. 3 and 6 (more overlap being advisable where an adjustable abutment member 28' is used). As shown in FIGS. 5 and 7, the abutment member 28, 28' abuts the far end 14*b*, 14*b*' of the mooring line receptacle 14, 14', such that the distal end 16*b*, 16*b*' of the mooring line 16, 16' cannot enter into the interior hollow 30, 30'.

Each mooring line receptacle 14, 14' is formed of an elongated sidewall 25, 25' composed of a durable material, preferably plastic. The sidewall 25, 25' forms the interior hollow 30, 30' and the slot 24, 24' provided in the sidewall communicates with the interior hollow and runs the length thereof. A preferred cross-sectional shape of the sidewall 25, 25' is cylindrical; if, however, added stability is desired, a flattened face may be provided at the exterior of the sidewall where it interfaces with the hull.

Figure 4:
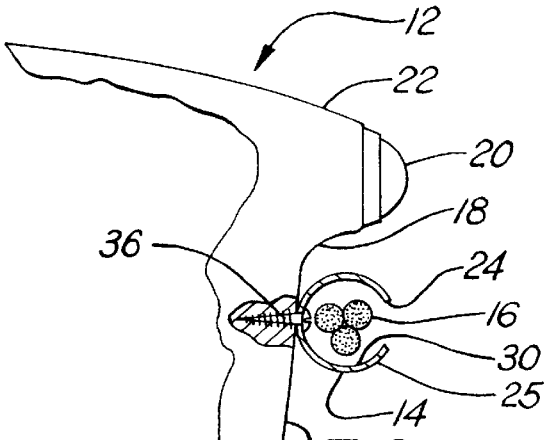
FIG. 4 is a partly sectional end view of the mooring line receptacle apparatus of FIG. 1, shown in operation with respect to the gunwale of a watercraft.
Figure 11:
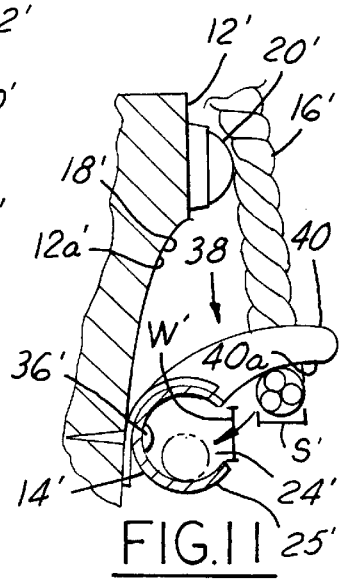
FIG. 11 is a partly sectional end view seen along line 11—11 in FIG. 10.

As depicted by FIGS. 4 and 11, the sidewall 25, 25' opposite the slot 24, 24' is attached to the hull 12*a*, 12*a*' of a selected watercraft 12, 12' via a number of spaced apart threaded fasteners 36, 36', such as screws. It is preferred to connect the mooring line receptacles 14, 14' to the hull 12*a*, 12*a*' at the gunwale 18, 18', since this is out of the way and easily reached; however, the mooring line receptacles could be placed elsewhere, such as the deck, wherein the slot would be oriented so that a person on a dock facility can pull on the mooring line and thereby cause it to be released from the interior hollow via exiting along the slot.

Figure 15A:
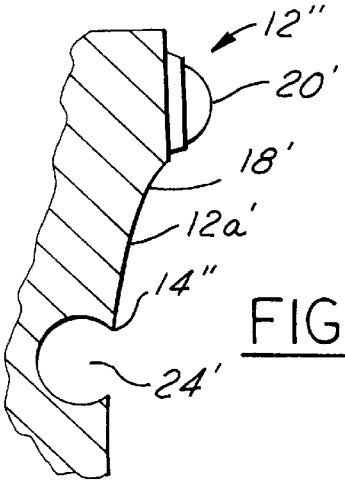
FIGS. 15A and 15B depict partly sectional views of a vessel, wherein the mooring line receptacle is integral with the hull thereof.
Figure 15B:
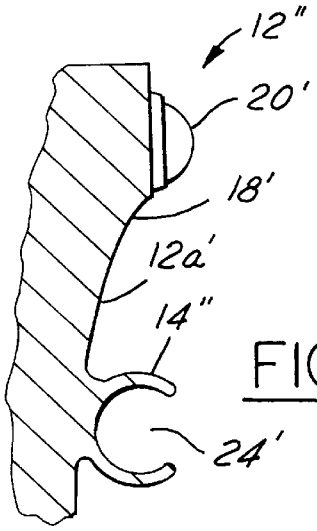

As further depicted by FIGS. 15A and 15B, the second mooring line receptacle apparatus may include mooring line receptacles 14" which are integral with the hull 12*a*" of a watercraft 12". FIG. 15A shows an integral interior placement, whereas FIG. 15B shows an integral exterior placement. Conceivably, the first mooring line receptacle apparatus may include mooring line receptacles which are similarly integral with the hull.

In operation, each mooring line 16, 16' is received into the interior hollow of a respective mooring line receptacle 14, 14' through the slot 24, 24' thereof, wherein the mooring line is thereafter removed therefrom via the slot in order to be used for moorage of the watercraft, as shown.

The particular structure and function of the first mooring line receptacle apparatus 10 will now be described with greater specificity.

The sidewall 25 is composed of a resilient material which is deformed when the mooring line 16 is passed through the slot 24. The interior hollow 30 has an inside diameter exceeding the cross-section S of the mooring line 16. The slot 24 of each mooring line receptacle 14 has a width W that is smaller than the cross-section S of the mooring line 16, such that the mooring line can be forced through the slot into the interior hollow 30 of the mooring line receptacle only by resiliently deforming the sidewall adjacent the slot to thereby spread the slot to a bigger width. Once the mooring line 16 is located in the hollow 30, it is trapped therein such that the mooring line cannot fall out of the hollow through the slot 24.

In operation each of the port bow, port stern, starboard bow and starboard stern mooring lines 16 are looped or otherwise connected with their respective cleat on the watercraft. Each mooring line is then respectively pressed resiliently into its mooring line receptacle via the slot thereof, as shown at the port side in FIG. 3. The abutment member 28 (or 28') then abuts the far end of the mooring line receptacle.

When docking, the skipper or a crew member grabs a mooring Line via its abutment member 28 on the side of the watercraft facing a dock facility 32, and then pulls upon the mooring line to thereby free it from its mooring line receptacle via exiting of the mooring line progressively along the slot thereof. The person then secures that mooring line in a conventional way to the dock facility, such as for example at a dock cleat 34 or dock piling as shown in FIGS. 1 and 3. Other of the mooring lines are then grabbed at their respective abutment member, freed and tied as was done with the first mooring line.

When it is time to shove-off, the mooring lines tied to the dock facility are released therefrom and then pressed through the slot, progressively along the subject mooring line receptacle with finally the abutment member abutting the far end of the mooring line receptacles, for later use when docking is to again take place.

The particular structure and function of the second mooring line receptacle apparatus 10' will now be described with greater specificity.

The sidewall 25' is any durable, structurally strong material, and may or may not be resilient. The interior hollow 30' has an inside diameter exceeding the cross-section S' of the mooring line 16'. The slot 24' of each mooring line receptacle 14' has a width W' that is larger than the cross-section S' of the mooring line 16', such that the mooring line easily passes through the slot into the interior hollow 30' of the mooring line receptacle without any resilient deforming of the sidewall adjacent the slot. Once the mooring line 16 is located in the hollow 30', it rests therein via the abutment member 28' (or 28) being abuttingly located at the far end 14*b*' of the mooring line receptacle 14' as shown in FIGS. 7 and 14.

In order for the mooring line 16' to commence entry into the slot 24' at the near end 14*a*' of the mooring line receptacle 14', a guide member 38 is utilized as a mooring line guide.

Figure 10:
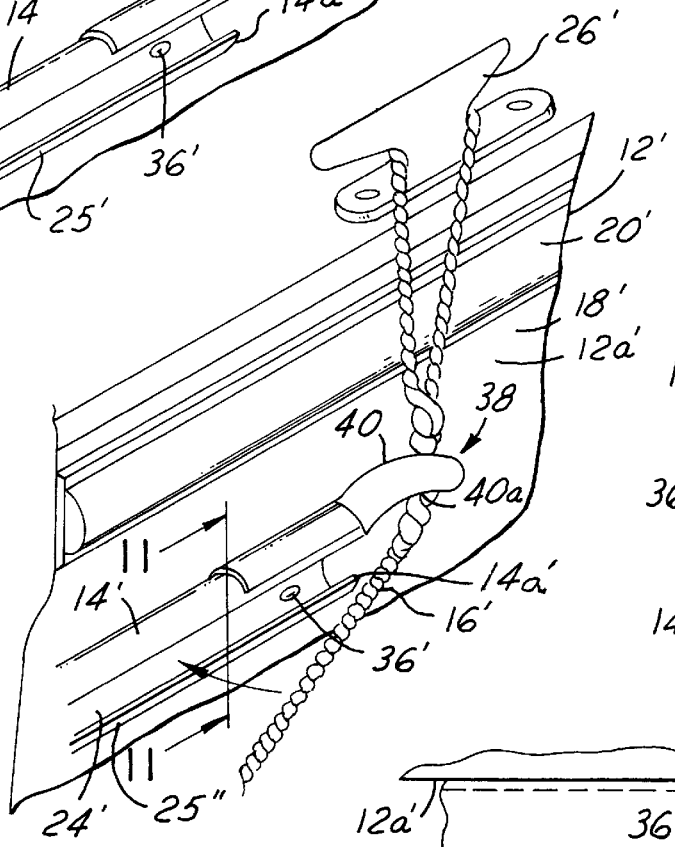
FIG. 10 is a broken-away perspective view of a vessel having the mooring line receptacle apparatus of FIG. 6, showing in particular a mooring line about to be placed in the slot thereof.
Figure 12:
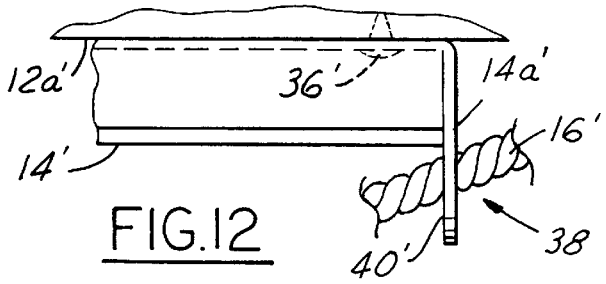
FIG. 12 is a top plan view of the mooring line receptacle apparatus of FIG. 6, shown in operation with a mooring line as in FIG. 11 wherein now the guide member is integral therewith.

As shown at FIGS. 6 and 9 through 12, a first form of guide member 38 is in the form of a guide arm 40 which includes a guide surface 40*a* which interfaces with the mooring line 16' such as to cause the mooring line to enter the slot 24' when pulled thereupon (see in particular FIGS. 10 and 11). The shape of the guide surface 40*a* may be any shape which facilitates guidance of mooring line 16' to enter the slot 24' at the end 14*a'* of the mooring line receptacle 14', as for example straight, convex, or concave (as shown). Flicking or otherwise manipulating the mooring line 16' may help in this regard. The guide arm 40 may be connected to the hull and/or the near end 14*a*' of the receptacle member 14' such as via a threaded fastener 36' or other fastener such as adhesive. Alternatively as shown at FIG. 12, the guide arm 40' may be integrally connected with the receptacle member 14'.

Figure 13:
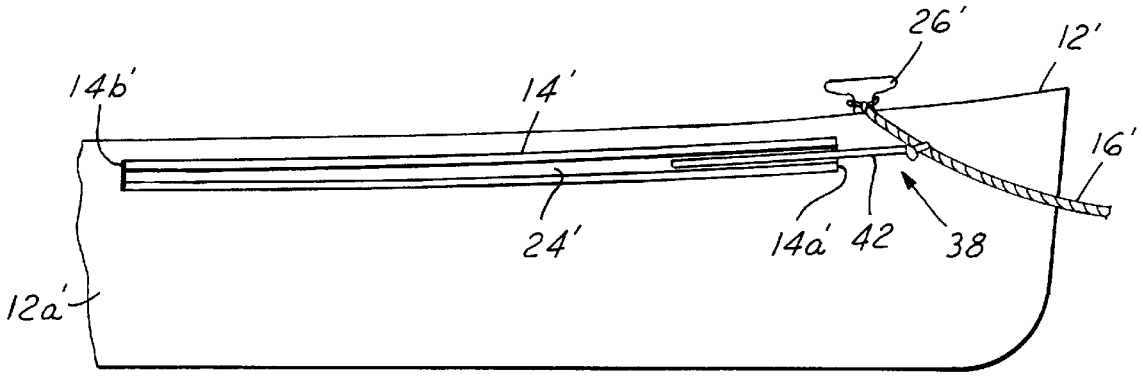
FIG. 13 is a partly broken-away side view of a vessel equipped with the second mooring line receptacle apparatus showing a guide member in the form of an elastic member, wherein the mooring line is shown in operation.
Figure 14:
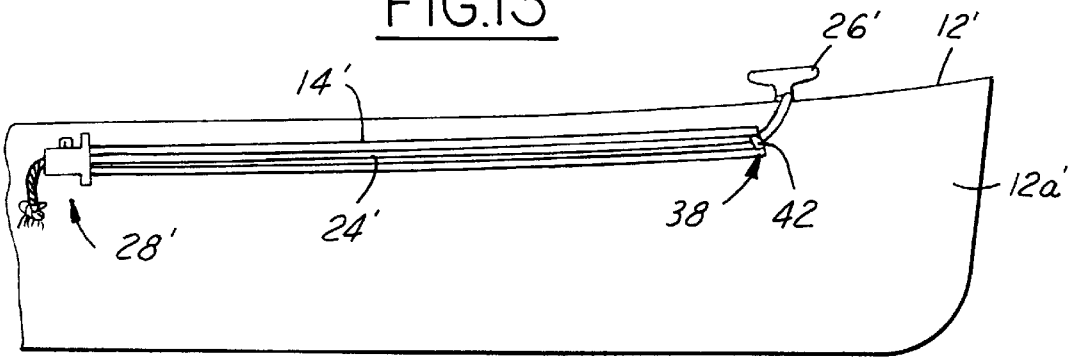
FIG. 14 is a partly broken-away side view of a vessel equipped with the second mooring line receptacle apparatus showing a guide member in the form of an elastic member, wherein the mooring line is shown stored.

As shown at FIGS. 13 and 14, a second form of guide member 38 is in the form of an elastic member 42 which is connected at one end to the receptacle member 14' at the interior hollow 30' and at the other end to the mooring line 16'. In operation, the elastic member 42 resiliently brings the mooring line 16' into the interior hollow 30' at the opening of the near end 14*b*' so that a user need only pull on the mooring line to cause it to pass progressively into the slot 24'.

With respect to where the mooring line receptacle members are integral with the hull, the guide member is preferred to be in the form of an elastic member interacting therewith as shown in FIGS. 13 and 14.

In operation each of the port bow, port stern, starboard bow and starboard stern mooring lines 16' are looped or otherwise connected with their respective cleat on the watercraft. Each mooring line is then respectively passed into its mooring line receptacle via the slot thereof, as shown at the port side in FIG. 6. Thereafter, its abutment member 28' (or 28) is secured to the far end 14*b*' of the mooring line receptacle member, wherein, preferably, the abutment member has been located on the mooring line so that mooring line is now generally taught in the mooring line receptacle so as to not fall out anywhere along the slot.

When docking, the skipper or a crew member grabs a mooring line via its abutment member 28' on the side of the watercraft facing a dock facility 32, and then pulls upon the mooring line to thereby free it from its mooring line receptacle via exiting of the mooring line from the slot thereof. The person then secures that mooring line in a conventional way to the dock facility, such as for example at a dock cleat 34 or dock piling, as shown in FIG. 6, and analogously by FIG. 1. Other of the mooring lines are then grabbed at their respective abutment member, freed and tied as was done with the first mooring line.

When it is time to shove-off, the mooring lines tied to the dock facility are released therefrom and then passed through the slot of the subject mooring line receptacle and the abutment member secured, for later use when docking is to again take place.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A mooring line receptacle apparatus for receiving a mooring line of a watercraft, comprising:

a mooring line having a predetermined cross-section, a proximate end and a distal end;

an elongated sidewall composed of a resilient material, said sidewall having a near end and an opposite far end, said sidewall forming an interior hollow having a predetermined inside diameter, said sidewall having a slot therein which communicates with said interior hollow, said slot extending from said near end to said far end, said slot having a predetermined width;

means for connecting said sidewall to a watercraft, wherein said sidewall is connected to the watercraft lengthwise between said far and near ends thereof wherein said slot is not occluded by the watercraft; and abutment means connected with said mooring line for preventing the distal end of said mooring line placed into said interior hollow from sliding into said interior hollow, said abutment means having adjustment means for selectively repositioning said abutment means along said mooring line;

wherein said slot has a width less than said cross-section of said mooring line and said inside diameter is larger than said cross-section of said mooring line such that said mooring line is pressed into and pulled out of said interior hollow of said mooring line receptacle by resiliently deforming said sidewall adjacent said slot, wherein said mooring line is placed into said interior hollow to thereby store at least a majority of said mooring line when not being used to moor the watercraft.

2. A water craft and mooring line receptacle apparatus for receiving a mooring line of the watercraft, comprising:

a watercraft having a hull; and at least one mooring line receptacle integrally formed with said hull, said mooring line receptacle comprising an elongated sidewall said sidewall having a near end and an opposite far end, said sidewall forming an interior hollow having a predetermined inside diameter, said sidewall having a slot therein which communicates with said interior hollow, said slot extending from said near end to said far end, said slot having a predetermined width;

wherein a mooring line of said watercraft is placed into and pulled out of said interior hollow through said slot, wherein the mooring line is placed into said interior hollow to thereby store at least a majority of the mooring line when not being used to moor the watercraft.

3. A mooring line receptacle apparatus for receiving a mooring line of a watercraft comprising:

a mooring line having a predetermined cross-section, a proximate end and a distal end;

an elongated sidewall, said sidewall having a near end and an opposite far end, said sidewall forming an interior hollow having a predetermined inside diameter, said sidewall having a slot therein which communicates with said interior hollow, said slot extending from said near end to said far end, said slot having a predetermined width;

means for connecting said sidewall to a watercraft, wherein said sidewall is connected to the watercraft lengthwise between said far and near ends thereof wherein said slot is not occluded by the watercraft; and means for preventing the distal end of said mooring line placed into said interior hollow from sliding into said interior hollow;

wherein said slot has a width greater than said cross-section of said mooring line and said inside diameter is larger than said cross-section of said mooring line such that said mooring line is placed into and pulled out of said interior hollow of said mooring line receptacle through said slot, and wherein said mooring line is placed into said interior hollow to thereby store at least a majority of said mooring line when not being used to moor the watercraft.

4. The mooring line receptacle apparatus of claim 3, further comprising guide member means for guiding entry of said mooring line into said slot adjacent said near end.

5. The mooring line receptacle apparatus of claim 4, wherein said means for preventing comprises:

an abutment member connected to said mooring line; and adjustment means for repositioning said abutment member to selectably fixed locations along said mooring line.

6. A water craft and mooring line receptacle apparatus comprising:

a watercraft;

at least one mooring line receptacle connected with said watercraft, said mooring line receptacle comprising:

an elongated sidewall, said sidewall having a near end and an opposite far end, said sidewall forming an interior hollow having a predetermined inside diameter, said sidewall having a slot therein which communicates with said interior hollow, said slot extending from said near end to said far end, said slot having a predetermined width; and means for connecting said sidewall to a watercraft, wherein said sidewall is connected to said watercraft lengthwise between said far and near ends thereof wherein said slot is not occluded by the watercraft:

at least one mooring line having a predetermined cross-section smaller than said width and smaller than said inside diameter; and means for preventing the distal end of said at least one mooring line placed into said interior hollow from sliding into said interior hollow;

wherein a mooring line of said at least one mooring line is placed into and pulled out of said interior hollow through said slot, wherein the mooring line is placed into said interior hollow to thereby store at least a majority of the mooring line when not being used to moor the watercraft.

7. The watercraft and mooring line receptacle apparatus of claim 6, further comprising guide member means for guiding entry of the mooring line into said slot adjacent said near end.

8. The watercraft and mooring line receptacle apparatus of claim 7, wherein said means for preventing comprises an abutment member connected to said at least one mooring line.

9. The watercraft and mooring line receptacle apparatus of claim 8, wherein said watercraft further comprises:

a hull;

a deck connected with said hull; and a plurality of cleats connected with said deck;

wherein said at least one mooring line receptacle comprises four mooring line receptacles comprising:

a first mooring line receptacle connected with said hull at substantially a port bow location of said watercraft;

a second mooring line receptacle connected with said hull at substantially a port stern location of said watercraft;

a third mooring line receptacle connected with said hull at substantially a starboard bow location of said watercraft; and a fourth mooring line receptacle connected with said hull at a substantially starboard stern location of said watercraft.

10. The watercraft and mooring line receptacle apparatus of claim 9, wherein said abutment member of said at least one mooring line further comprises adjustment means for repositioning said abutment member to selectably fixed locations along its respective mooring line.

11. The watercraft and mooring lie receptacle apparatus of claim 9, wherein said watercraft has a gunwale; further wherein said at least one mooring line receptacle is connected to said watercraft substantially adjacent to, and substantially parallel with, said gunwale.

12. The watercraft and mooring line receptacle apparatus of claim 11, wherein said plurality of cleats comprise:

a first cleat located at said port bow of said watercraft;

a second cleat located at said port stern of said watercraft;

a third cleat located at said starboard bow of said watercraft; and a fourth cleat located at said starboard stern of said watercraft;

wherein said near end of said first mooring line receptacle is located substantialy adjacent said first cleat;

wherein said near end of said second mooring line receptacle is located substantially adjacent said second cleat;

wherein said near end of said third mooring line receptacle is located substantlially adjacent said third cleat; and wherein said near end of said fourth mooring line receptacle is located substantially adjacent said fourth cleat.

13. The watercraft and mooring line receptacle apparatus of claim 12, wherein said at least one mooring line comprises four mooring lines comprising:

a first mooring line having a proximate end and an opposite distal end, wherein when said proximate end of said first mooring line is connected with said first cleat and said first mooring line is placed into said hollow interior of said first mooring line receptacle, then said distal end of said first mooring line is located outside said first mooring line receptacle such that said abutment member of said first mooring line is abuttable with said far end of said first mooring line receptacle;

a second mooring line having a proximate end and an opposite distal end, wherein when said proximate end of said second mooring line is connected with said second cleat and said second mooring line is placed into said hollow interior of said second mooring line receptacle, then said distal end of said second mooring line is located outside said second mooring line receptacle such that said abutment member of said second mooring line is abuttable with said far end of said second mooring line receptacle;

a third mooring line having a proximate end and an opposite distal end, wherein when said proximate end of said third mooring line is connected with said third cleat and said third mooring line is placed into said hollow interior of said third mooring line receptacle, then said distal end of said third mooring line is located outside said third mooring line receptacle such that said abutment member of said third mooring line is abuttable with said far end of said third mooring line receptacle; and a fourth mooring line having a proximate end and an opposite distal end, wherein when said proximate end of said fourth mooring line is connected with said fourth cleat and said fourth mooring line is placed into said hollow interior of said fourth mooring line receptacle, then said distal end of said fourth mooring line is located outside said fourth mooring line receptacle such that said abutment member of said fourth mooring line is abuttable with said far end of said fourth mooring line receptacle.

14. The watercraft and mooring line receptacle apparatus of claim 13, wherein said far end of each of said first and second mooring line receptacle members are proximate each other substantially amidship of said watercraft, and wherein said far end of each of said third and fourth mooring line receptacle members are proximate each other substantially amidship of said watercraft.

15. The watercraft and mooring line receptacle apparatus of claim 14, wherein said abutment member of each said mooring line further comprises adjustment means for repositioning said abutment member to selectably fixed locations along its respective mooring line.

16. A method for storing a mooring line of a watercraft when the mooring line is not being used to moor the watercraft, said method comprising the steps of:

providing a mooring line having a cross-section, a proximate end and an opposite distal end;

forming an elongated member having a sidewall having a near end and an opposite far end, wherein said sidewall provides an interior hollow extending between the near and far ends;

forming a slot in said sidewall between the near and far ends thereof, wherein the slot has a width that is larger than the cross-section of the mooring line;

connecting the elongated member lengthwise between the near and far ends thereof to a watercraft, wherein the slot is unobstructed by the watercraft;

placing the mooring line into the interior hollow so that at least a majority of the mooring line is situated storingly in the interior hollow.

17. The method of claim 16, further comprising the step of preventing the proximate and distal ends of the mooring line from entering the interior hollow at the near and far ends, respectively.

* * * * *